United States Patent [19]

Ohno

[11] Patent Number: 4,676,224

[45] Date of Patent: Jun. 30, 1987

[54] HEATING AND MELTING APPARATUS FOR MELTING A SUBSTANCE TO BE MELTED

[75] Inventor: Junichi Ohno, Tokyo, Japan

[73] Assignee: Kabushiki Kaisha Meidensha, Tokyo, Japan

[21] Appl. No.: 723,886

[22] Filed: Apr. 16, 1985

[30] Foreign Application Priority Data

Apr. 19, 1984 [JP] Japan ..... 59-79282
Feb. 1, 1985 [JP] Japan ..... 60-18127

[51] Int. Cl.[4] ..... E01H 5/00

[52] U.S. Cl. ..... 126/343.5 R; 37/228; 219/388

[58] Field of Search ..... 219/388, 421; 126/343.5 R, 343.5 A; 37/228

[56] References Cited

U.S. PATENT DOCUMENTS 2,619,745 12/1952 Viviano ..... 126/343.5 R
2,696,814 12/1954 Townsend ..... 126/343.5 R
3,066,428 12/1962 Raiti ..... 126/343.5 R
3,333,354 8/1967 Kirshenblat ..... 126/343.5 R
3,387,603 6/1968 Marks et al. ..... 126/343.5 R
3,405,705 10/1968 Devlin et al. ..... 126/343.5 R
4,353,176 10/1982 Hess ..... 126/343.5 R

*Primary Examiner*—Robert L. Spruill
*Assistant Examiner*—Donald R. Studebaker
*Attorney, Agent, or Firm*—Bachman & LaPointe

[57] ABSTRACT

A heating and melting apparatus according to the present invention has a housing for receiving a substance to be melted, a heater for heating the housing in order to melt the substance, and a vessel for receiving and storing the resulting liquid. The liquid stored in the vessel is exhausted from the vessel in an effectively utilizable form. The operation of the apparatus is controlled by a processing unit in accordance with the temperatures of the housing and the liquid stored in the vessel.

23 Claims, 12 Drawing Figures

HEATING AND MELTING APPARATUS FOR MELTING A SUBSTANCE TO BE MELTED

FIELD OF THE INVENTION

The present invention relates to an improved heating and melting apparatus and, more particularly to the heating and melting apparatus for quickly melting a substance to be melted such as snow, asphalt or the like.

BACKGROUND OF THE INVENTION

In the areas subject to heavy snowfall, a great deal of human effort as well as a large amount of money is required to remove snow from roads, railways, air ports, cemetary and the like.

Traffic conditions on roads and railways, however, remain badly degraded, with the top speed and capacity of cars or trains severely limited, since the width of the cleared surface of the road remains narrow due to snow drifts formed in the snow removal process and due to the adverse effect on the road surface itself.

In recent years, the snow removal techniques have improved as apparatus for removing snow. Known heating and melting apparatus are provided with oil burners or gas burners for melting a substance such as snow, asphalt or the like. These are, however, unsolved problems in known methods for removing snow, and small pieces of ice from roads, railways and the like. It was impossible to obtain a fully wide area for snow drifting and method for removing the snow effectively.

SUMMARY OF THE INVENTION

It is an object of the present invention to provide a heating and melting apparatus which corrects the above mentioned problems and can quickly melt a substance to be melted and advantageously use the resulting melt.

To achieve the above object, the present invention provides a heating and melting apparatus comprising a receiving means for receiving a substance to be melted, a transferring means for conveying the substance into the receiving means, a heating means for heating the receiving means in order to melt the substance in the receiving means, a heat energy supply means for supplying heating energy to the heating member, a liquid receiving means for receiving melt from the receiving means, a liquid exhaust means for exhausting the liquid stored in the liquid receiving means, and an operation control means for controlling the heat energy supply means and the liquid exhaust means.

BRIEF DESCRIPTION OF THE DRAWINGS

Features and advantages will be made apparent in the following description with reference to the accompanying drawings.

In the drawings.

DETAILED DESCRIPTION OF THE PREFERRED EMBODIMENTS

Figure 1:
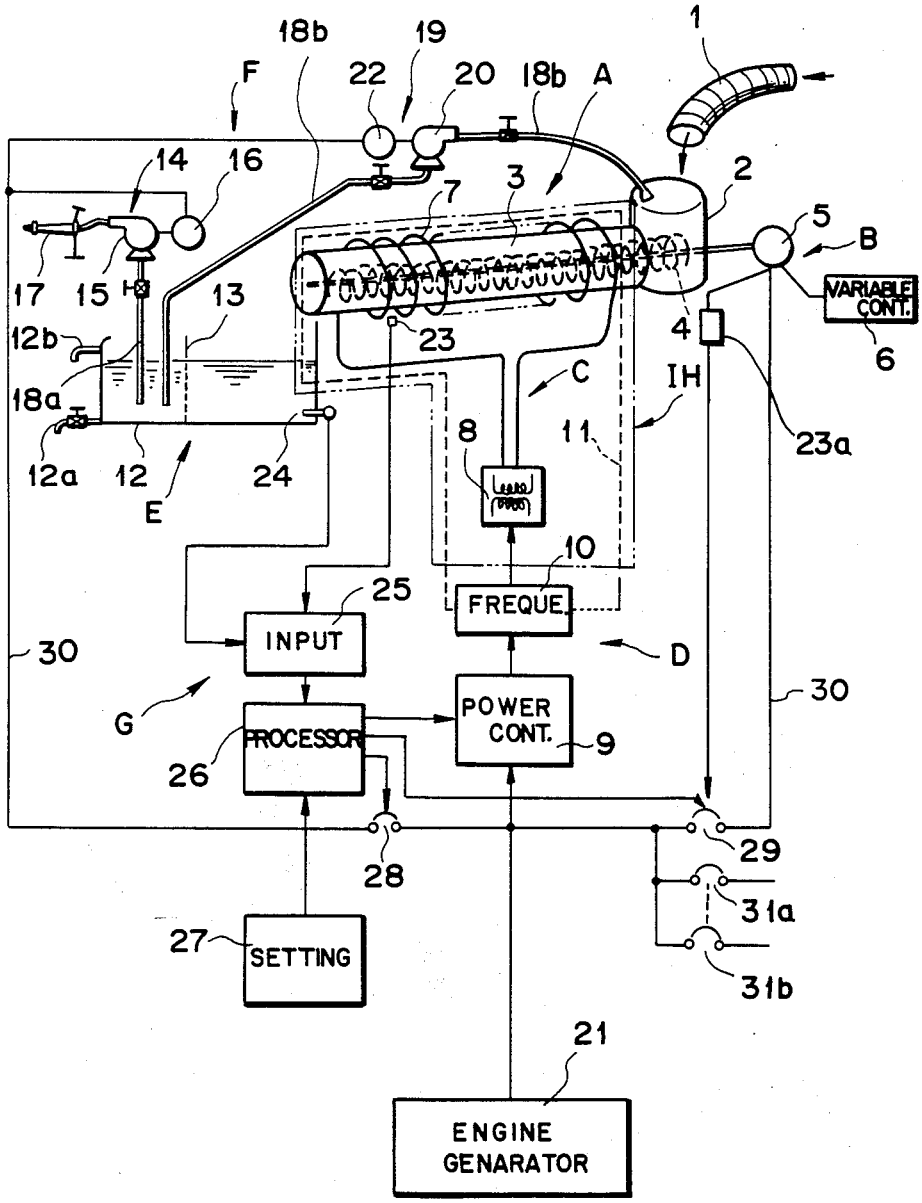
FIG. 1 is a block diagram of an embodiment of a heating and melting apparatus according to the present invention.

Referring to the drawings, FIG. 1 shows a heating and melting apparatus of an embodiment according to the present invention. The heating and melting apparatus comprises substantially a receiving member A for receiving a substance to be melted, a transferring member B for conveying the substance to the receiving member A, a heating member C for heating the receiving member A in order to melt the substance, a heat energy supply member D for supplying heating energy to the heating member C, a liquid receiving member E for receiving liquid from the receiving member A, a liquid exhaust member F for exhausting the liquid stored in the liquid receiving member E, and an operation control member G for controlling the heat energy supply member D and the liquid exhaust member F.

The receiving member A includes a container (receptacle) 2 for receiving a solid state substance such as snow from a snow removal vehicle (not shown in FIG. 1) through a lead pipe 1 and a melt housing in the form of a melting tube 3 of which one end is secured to the container 2 so as to communicate with the container 2. The transferring member B includes a conveyor means in the form of a screw conveyor 4, a drive motor 5 for driving the screw conveyor 4 and a variable speed control device 6 for controlling the drive motor 5. The substance such as snow is transferred from the snow removal vehicle by way of the lead pipe 1 to the container 2. The snow stored in the container 2 is conveyed into the melting pipe 3 by means of the screw conveyor 4. The screw conveyor 4 is driven by the drive motor 5 which is controlled by the variable speed control device 6.

The heating member C comprises an inductive heating device IH including a heating coil 7 wound around the melting tube 3 and a matching transformer 8. The heat energy supplying member D includes an electric power control unit 9, and a frequency converter 10 which controls the frequency of the electric power to be supplied to the matching transformer 8 of the induction heating unit IH. A shield 11 surround the inductive heating unit.

An electric power supply in the form of an engine generator 21 is electrically connected to the power control unit 9. The power control unit 9 is connected to a frequency converter 10. The frequency converter 10 is electrically connected to the induction heating coil 7 by way of the matching transformer 8. The power control unit 9 controls the frequency converter 10, and thereby the heating current of the inductive heating coil 7 is controlled to adjust the heat applied to the melting tube 3. The melting tube 3 is made of a metallic material such as magnetic material and is heated by the induction heating coil 7 to melt the snow in the melting pipe 3.

The liquid receiving member E includes a vessel 12 for receiving and storing the liquid from the melting tube 3 of the receiving member A. The vessel 12 is located to the free end of the melting tube 3. In the melting tube 3, the snow is melted and the resulting water is further heated by the melting tube 3. The hot water produced in the melting tube 3 is stored in the vessel 12.

The liquid exhaust member F comprises a drain 12*a* mounted near the bottom of the vessel 12, a drain valve 12*b* mounted near the top of the vessel 12, a dispersion unit 14 for dispersing the hot water in the vessel 12, and a return line 19 for feeding some of the hot water in the vessel 12 back to the container 2. The dispersion unit 14 comprises a dispersing pump 15 equipped with a motor 16 and an ejection valve 17. The pump 15 is connected to one end of a pipe 18*a*, the other end of which projects into the vessel 12. The return line 19 includes a recirculation pump 20 driven by a motor 22 connected to a lead pipe 18*b*. One end of the pipe 18*b* projects into the vessel 12, and other end of the pipe 18*b* empties into the top of the container 2 by means of recirculating pump 20. A dust filter 13 in the vessle 12 prevents particulates from the melting tube 3 from entering the pipes 18*a* and 18*b*. Th emotor 5, 16 and 22 are electrically connected to the engine generator 21 by way of switches 28 and 29, and a lead 30. Switches 31*a* and 31*b* are power source switches for motors (not shown in the drawings) driving external devices (not shown in the drawings).

The operation control member G includes a thermosensor 23 mounted on the melting tube 3 in order to detect the temperature of the melting tube 3, a thermosensor 24 installed in the vessel 12 in order to detect the temperature of the liquid stored in the vessel 12 and a thermal relay 23*a* for actuating the switches 29 in response to the temperature of the driving motor 5. The operation control member G further includes an input unit 25 receiving detection signals from the thermosensors 23 and 24, a processing unit 26 in the form of a mircoprocessor which receives signals from the input unit 25, and a setting and indication unit 27. The processing unit 26 uses the detection signals from the theremosensors 23 and 24 and the setting signals from the unit 27 to control the power control unit 9 and the switches 28, 29. The power control unit 9 controls the induction heating member IH in response to instructive signals from the processing unit 26.

Figure 2:
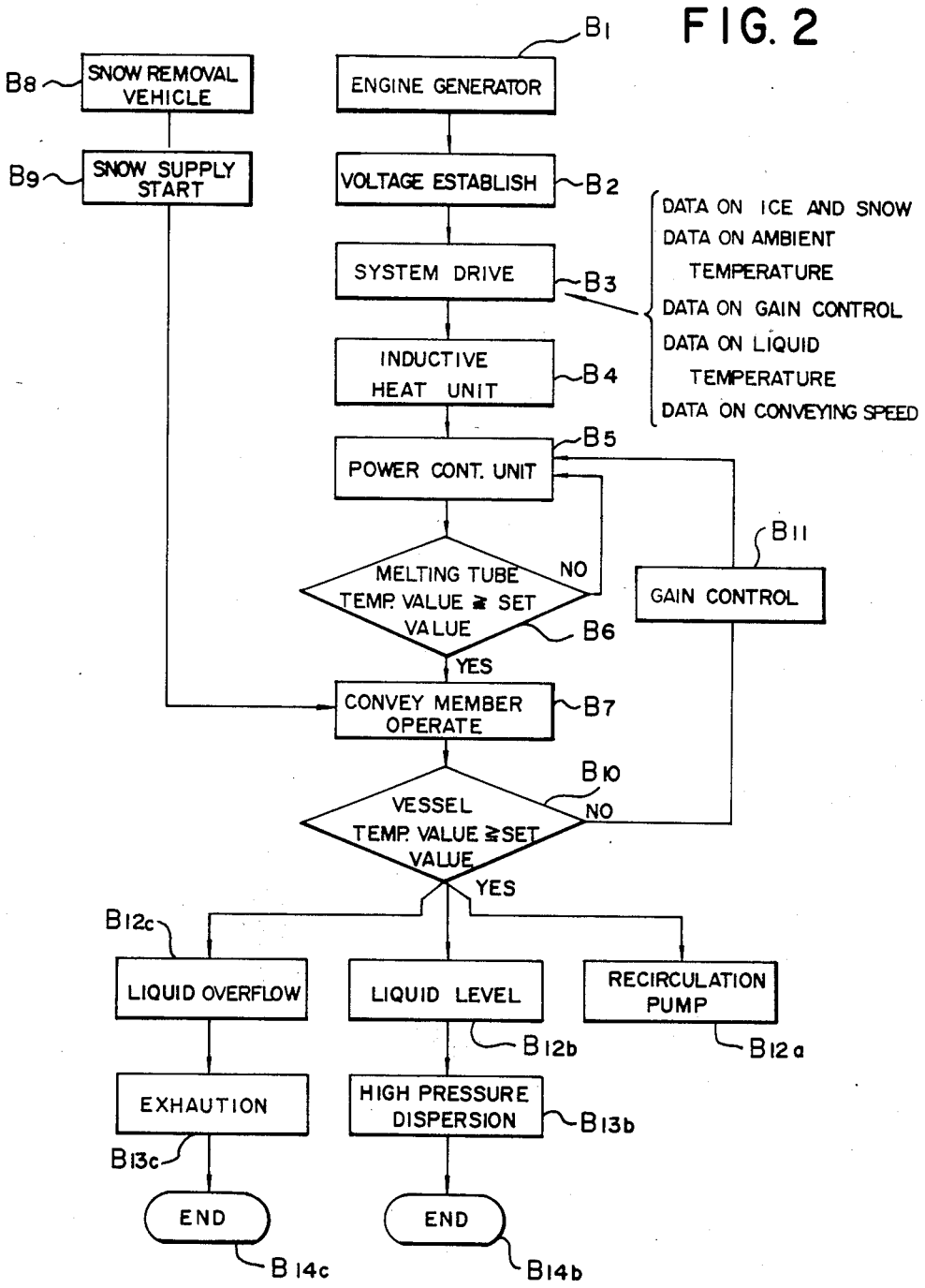
FIG. 2 is a flowchart of operation of the system of FIG. 1.

The operation of the heating and melting apparatus will be described with reference to a flow chart shown in FIG. 2.

An engine generator 21 is started as shown at block $B_1$ and thus an output voltage of the engine generator 21 rises to predetermined voltage as shown at block $B_2$. Thereafter, the apparatus is initialized at a block $B_3$. In block $B_3$, various data are set to desired values via the setting unit 27. The various data include ice and snow conditions such as qualities of ice and snow, ambient temperature, control gain, the temperature of the hot water and the feed rate of the conveyor means. After initialization, the induction heating unit IH is activated by means of an instruction from the processing unit 26, as shown in block $B_4$. The electric power for the induction heating unit IH is controlled by the power control unit 9, at a block $B_5$. When the temperature of the melting tube reaches or exceeds a predetermined value, the switch 29 is closed in response to an instruction from the mircoprocessor 26, and thereby the drive motor 5 is driven to operte the screw conveyor 4 as shown in blocks $B_6$ and $B_7$.

If the temperature of the melting tube 3 is below the set value, the control loop $B_5$–$B_6$ for the electric power of the induction heating unit is repeated.

When the screw conveyor 4 is running, the snow supplied by the removal vehicle is conveyed to the container 2 as shown in blocks $B_8$, $B_9$ and $B_7$. The snow stored in the container 2 is transfered to the melting tube 3 by means of the screw conveyor 4. The snow transferred into the tube 3 is melted and thereby the hot water is produced since the melting tube 3 is already heated. The hot water in the melting tube 3 is supplied to the vessel 12 for storage. The temperature of the water in the vessel 12 is monitored by the thermosensor 24. If the temperature is less than the set value, the processing unit 26 proportionally controls the heating current at a block $B_{11}$ and the operations shown in the blocks $B_5$, $B_6$, $B_7$ and $B_{10}$ are repeated until the temperature of the water reaches the set value. After the temperature of the water eaches the set value, the switch 28 is closed in response to an instruction from the processing unit 26, which also orders operation of the motor 16 of the dispersion pump 15 and the motor 22 of the recirculation pump 20.

The recirculating pump 20 returns hot water from the vessel 12 to the container 2 in order to facilitate melting of the snow in the receiving member A, as is shown in a block $B_{12a}$. When the water level reaches a predetermined level, the dispersion unit 14 is activated to spray a high pressure hot water jet over snow on roofs, roads or the like at blocks $B_{12b}$, and $B_{13b}$ and $B_{14b}$, and thereby fulfilling the desired purpose of the apparatus. When the vessel 12 is full, water drains through the overflow pipe 12*b*, as shown in blocks $B_{12c}$ and $B_{13c}$.

Figure 3:
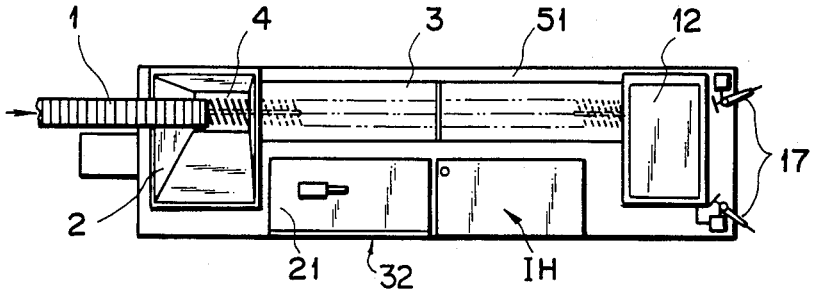
FIG. 3 is a plan view of a mobile heating and melting apparatus.
Figure 4:
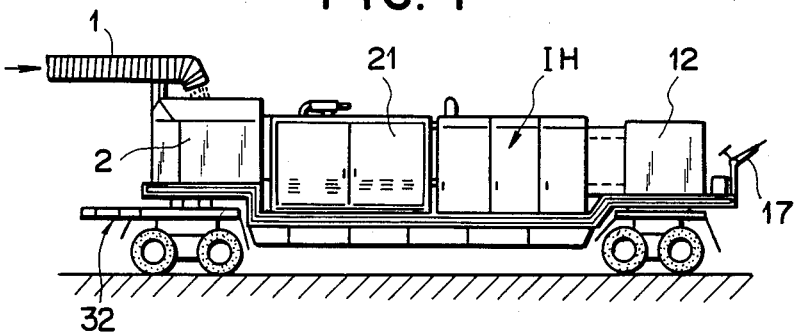
FIG. 4 is a side view of the heating and melting apparatus of FIG. 3.
Figure 5:
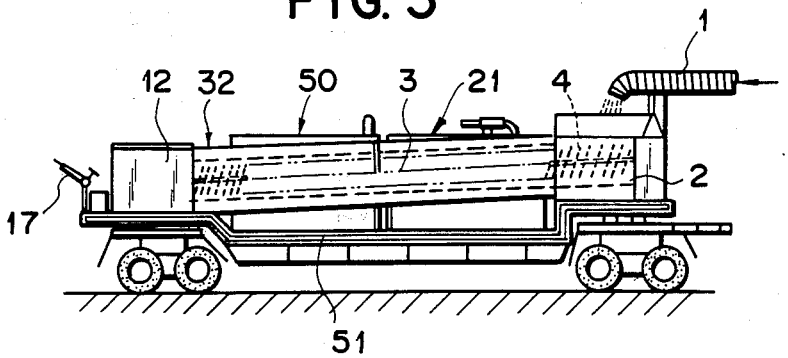
FIG. 5 shows the other side of the heating and melting apparatus of FIG. 3.

The heating and melting apparatus shown in FIG. 1 can be mounted on a vehicle such as a truck trailer as is shown in FIGS. 3 to 5. In FIGS. 3 to 5, elements identical or corresponding to those shown in FIG. 1 are labelled with the same reference characters. As shown in FIGS. 3 and 4, the container 2 is mounted on the rear end of a truck trailer 32 (the left-hand side in FIGS. 3 and 4), and the vessel 12 is mounted on the front end of the truck trailer 32 (the right-hand side in FIGS. 3 and 4). The electrical generator 21 and the inductive heating unit IH are mounted on the trailer truck between the container 2 and the vessel 12. The container 2 is connected to the vessel 12 by way of a melting tube 3 as shown in the rear view of FIG. 5.

Figure 6:
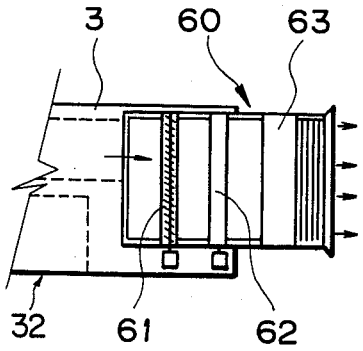
FIG. 6 is a partial plan view of a modification of a mobile heating and melting apparatus.
Figure 7:
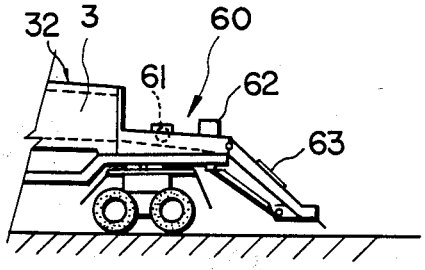
FIG. 7 is a side view of a modification of the heating and melting apparatus of FIG. 6.

The apparatus of FIG. 1 can also be used in conjunction with a paving apparatus for paving roads with asphalt. FIGS. 6 and 7 show a paving apparatus. A paving machine 60 is mounted on a truck trailer 32 inplace of the vessel 12 (shown in FIG. 1) after removing the vessel 12. The paving machine 60 is provided with the stirring device 61, an extruder 62 and a pressing plate 63.

Although FIGS. 3 to 7 show mobile heating and melting apparatus, the invention is not limited to this type, but rather may be stationarily mounted. By mounting the engine generator 21 on another vehicle, a part of the apparatus is made small and thereby operation can be carried out in the narrower area.

Figure 8:
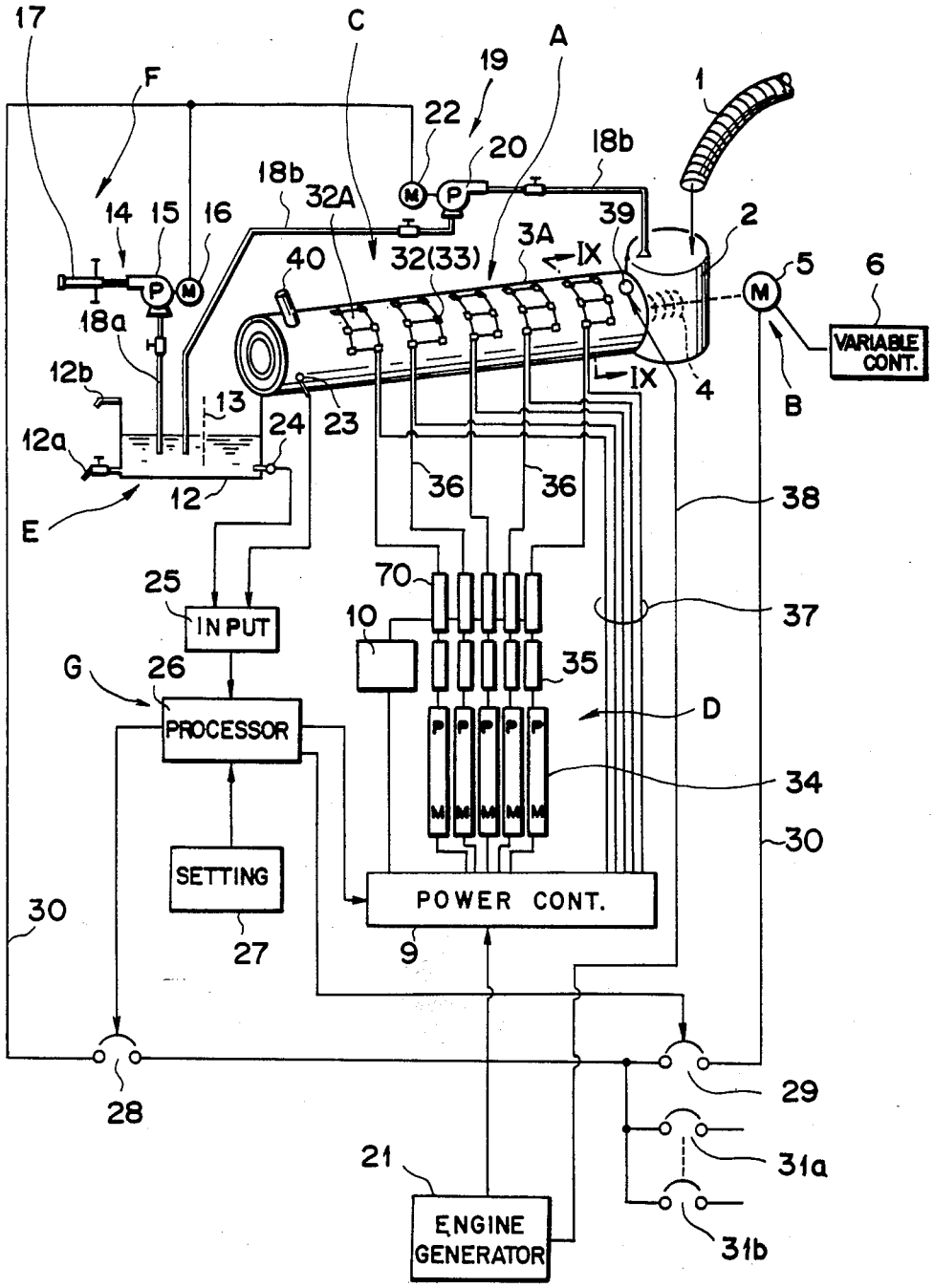
FIG. 8 is a block diagram of a modification of the heating and melting apparatus of FIG. 1.
Figure 9:
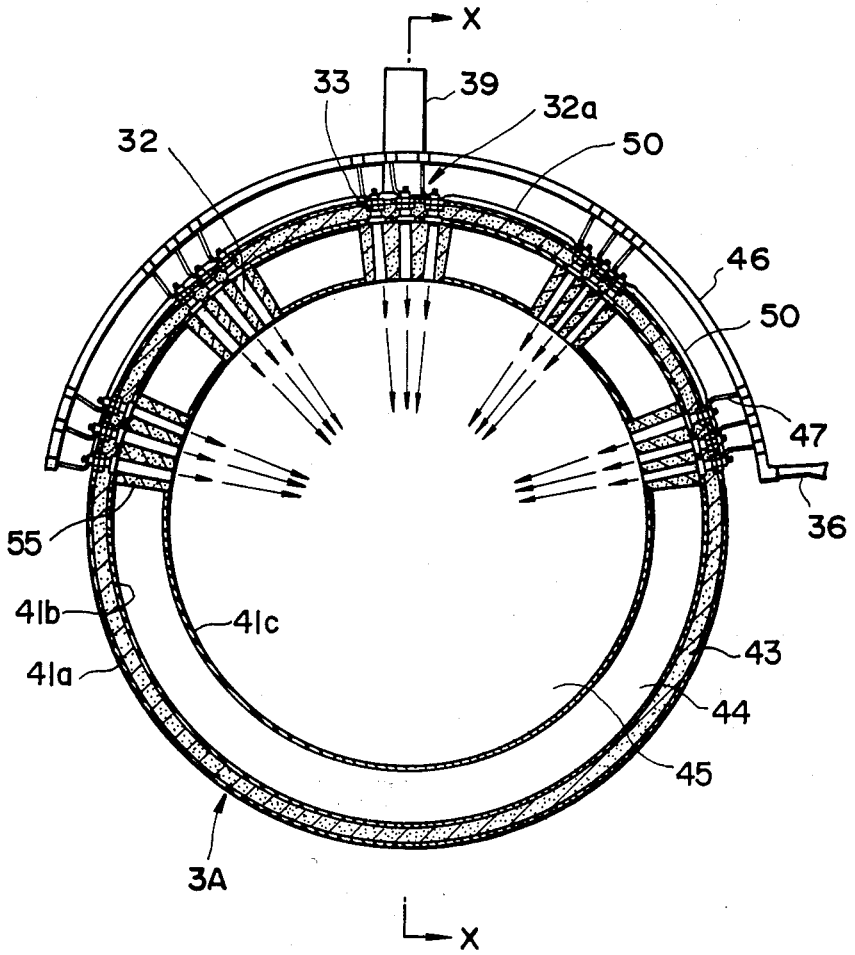
FIG. 9 is a cross-sectional view taken along line IX—IX of FIG. 8.
Figure 10:
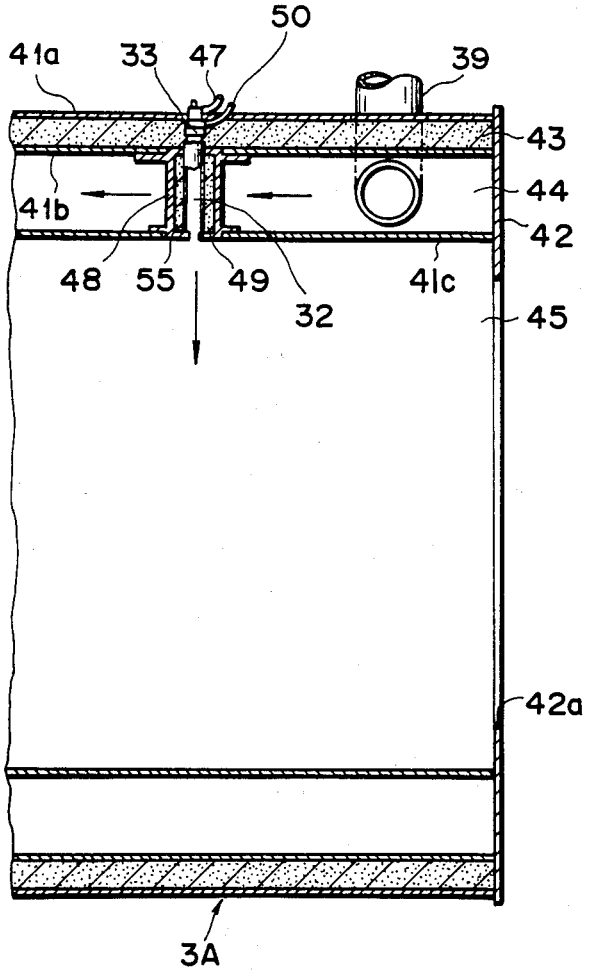
FIG. 10 is a partial sectional view taken along line X—X of FIG. 9.

FIGS. 8 to 10 show a modification of the heating and melting apparatus of FIG. 1. According to the apparatus of FIGS. 8 to 10, a hot blast blows continuously through a receiving member receiving a substance to be melted, and thereby the receiving member is heated in order to melt the substance converyed into the receiving member. The resulting liquid can be employed to melt snow and its melting efficiency can be enhanced by recirculating the heated liquid through the receiving member.

As is shown in FIG. 8, a receiving member A receiving a substance to be melted includes a melting tube 3A. A heating member C comprises a plurality of heat pipes 32 and associated electric heaters 33 mounted on the heat pipes 32.

A heating energy supply unit D includes an electric power control unit 9 and compressors 34 connected electrically to the control unit 9. Each of the compressors 34 is connected to a corresponding heat pipe 32 by way of a corresponding air conduit 36. The electric heaters 33 are electrically connected to the power control unit 9 by power lines 37. The melting tube 3A is connected to a gasoline or diesel generator 21 via a conduit 38 and an inlet port 39. The exhaust gas from the engine generator 21 is conducted to the melting tube 3A by way of the conduit 38 and the inlet pipe 39. The exhaust gas passes through the melting tube 3A and exit via an outlet pipe 40.

As is best shown in FIGS. 9 and 10, the melting tube 3A is formed with an outer tubular portion in the form of a first tubular section 41*a*, a second tubular section 41*b* having a smaller diameter than the first tubular section, an inner tubular portion in the form of a third tubular section 41*c* having a diameter smaller than the second tubular section, and a disc-shaped plate 42 with a central bore 42*a* fastened to the upstream end of the melting tube 3A. An adiabatic material 43 is inserted between the first tubular section 41*a* and the second tubular section 41*b*. A cavity 44 is defined between the second and third tubular sections. A heating medium, specifically exhaust gases from the engine generator, is supplied to the cavity 44 (as described above).

As shown in FIG. 9, hot jets enter the melting tube 3A through the heat pipes 32 to heat the melting tube 3A and to heat the snow directly. The plurality of heat pipes 32 surround the melting tube 3A in a plurality of heating element groups 32*a*. As shown in FIG. 9, the heating element groups 32*a* are spaced along the length of the tube 3A and form the heating member C. The heat pipes 32 of each heating element group 32A are connected to corresponding air conduits 36 by way of a common air conduit 46 and individual branch pipes 47. The air conduits 36, the common air conduit 46 and the branch pipes 47 are insulated with the adiabatic material 43 according to need.

As shown in FIG. 10, each heat pipe 32 is secured by a support 48 disposed between the second and third tubular sections of the melting tube 3A.

Adiabatic material 55 fills the gaps between the heat pipe 32 and the support 48. The stainless steel inlet pipe 39 connects the engine generator 21 to the cavity 44 between the first and second tubular sections. Each of the heaters 33 is wound around the corresponding heat pipe 32. These heaters 33 are connected to the control unit 9 by leads 37. The use of the heat pipe 32 makes the heating member C of the heating and melting apparatus small size and light weight as well as optimum heat control can be performed ecconomically.

As described above, the melting tube 3A is heated by the hot gases from the heat pipe 32 and the engine generator 21. The heat pipes 32 are heated or preheated by the electric heaters 33 and thereby the heating efficiency of the heating member C is considerably enhanced.

Figure 11:
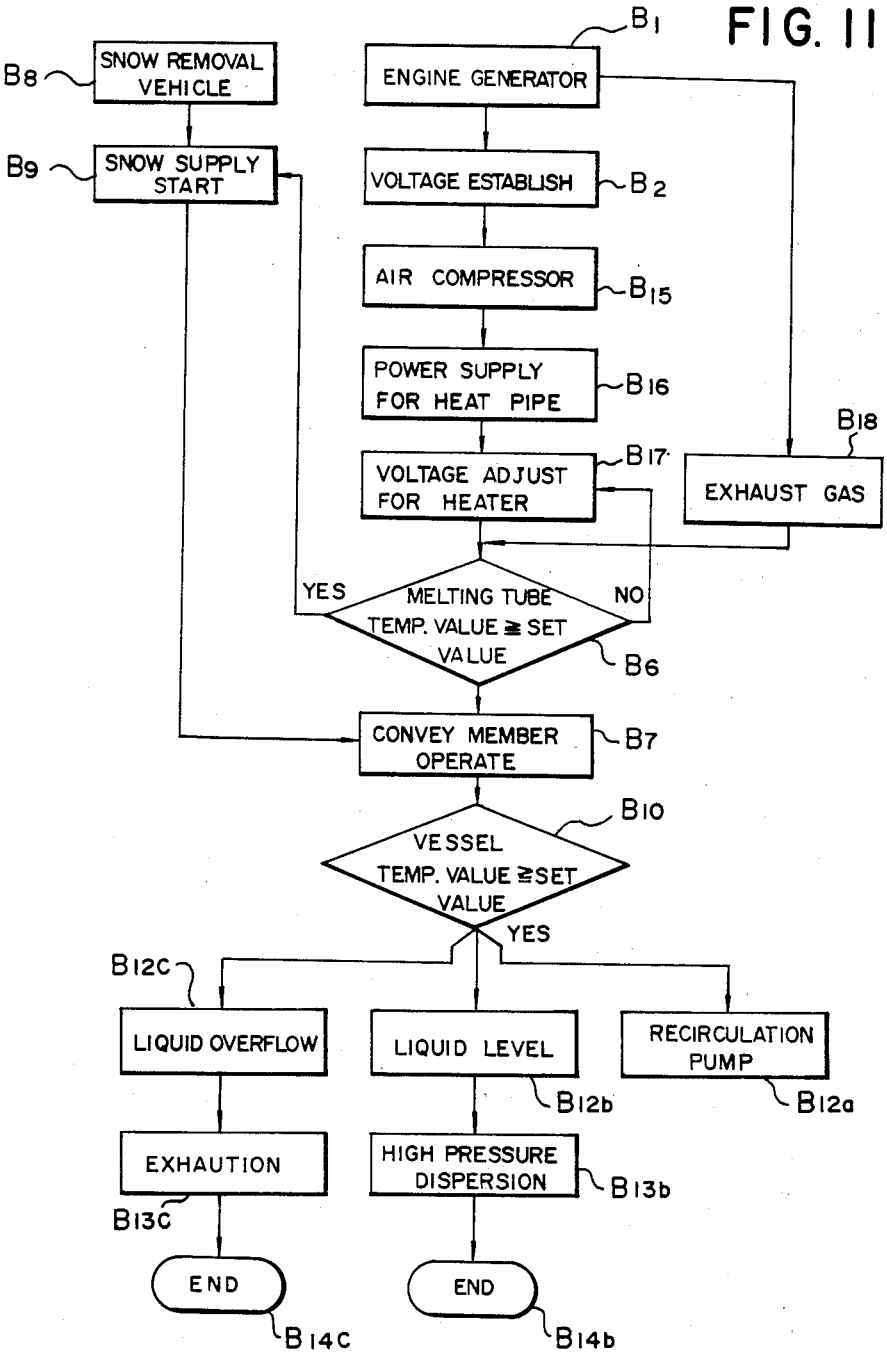
FIG. 11 is a flowchart of operation of the heating and melting apparatus of FIG. 8.

The operation of the apparatus of FIGS. 8 to 10 will be explained with reference to FIG. 11. The power control unit 9 is activated in response to an instruction from the microprocessor 26 after the output voltage of the engine generator 21 is established. Upon activation of the power control unit 9, operation of the compressors commences as shown in a block $B_{15}$, and compressed air is supplied to the heat pipers 32. The hot jets blow into the melting tube 3A, as is shown by the arrows in FIG. 10. Activation of the power control unit 9 also initiates current supply to the heaters 33 as shown in blocks $B_{16}$ and $B_{17}$. The exhaust gas from the engine generator 21 is supplied to the melting tube 3A whereby the exhaust gas is employed to heat the melting tube 3A, as is shown in a block $B_{18}$.

If the temperature of the melting tube 3A is equal or lower than a set temperature, the heat pipes 32 are continuously heated by adjusting their supply voltage. Moreover, the number of the heat pipes 32 and heaters 33 used is selected in accordance with the temperature of the liquid stored in the vessel 12 and the melting tube 3A. Specifically, the processing unit 26 uses the detection signals from the thermosensors 23 and 24 to control the power control unit 9. The power control unit 9 controls the power of the compressors 34 and the electric heater 33 so as to control the temperature of the melting tube 3A.

According to the apparatus of FIGS. 8 to 10, an inductive heating unit can be added to the heat energy supply unit D if the heating rate due to the hot air jets from the heat pipes 32 must be augmented. An inductive heating unit 70 is provided in each of the conduits 36 as is shown in FIG. 8. Electrical power is supplied to the inductive heating units 70 via a frequency converter 10.

Figure 12:
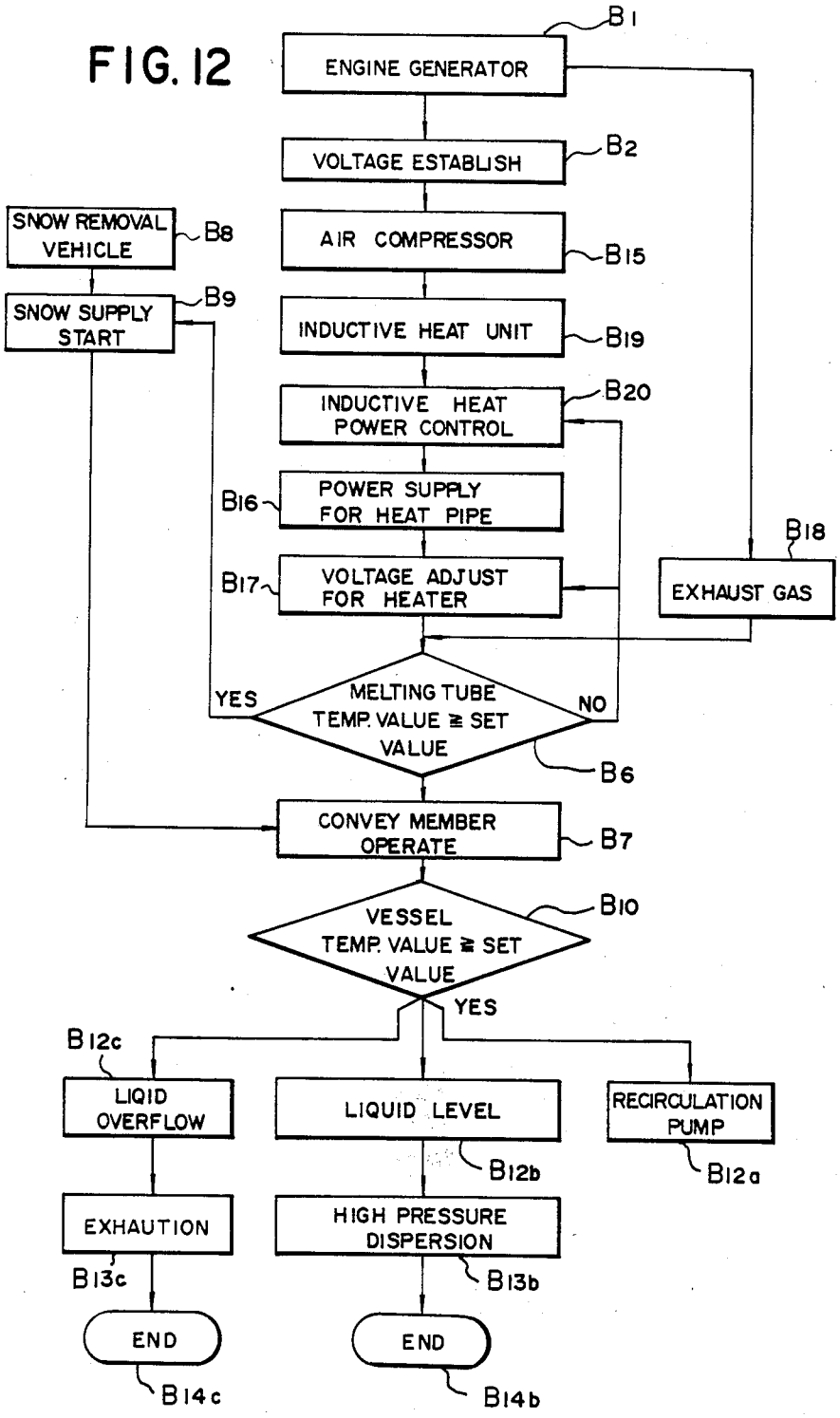
FIG. 12 is a modified flowchart of operation of the heating and melting apparatus of FIG. 8.

In the heating and melting apparatus having the inductive heating units 70, the inductive heating units 70 are operated after the air compressor 34 are started as shown in blocks $B_{15}$ and $B_{19}$ of FIG. 12. When the inductive heating units 70 are running, the power control unit 9 controls the frequency converter 10 and thereby controls the inductive heating units 70 as shown in a block $B_{20}$. After controlling the inductive heating unit 70, the electric power is supplied to the electric heaters 33 as shown in a blocks $B_{16}$ and thereafter the heater voltage is adjusted (block $B_{17}$). After adjustment of the heater voltage, power control for the inductive heating units 70 and adjustment of the heater voltage is repeated as long as the temperature of the melting tube 3A remains lower than the set value.

The heating and melting apparatus of FIG. 8 can be made more compact and lighter as well as being provided enhanced temperature characteristics due to the heat pipes 32 in the heating member C. Moreover, the heating and melting apparatus of FIG. 8 can control suitably heat of the melting tube 3A heat control, since the number of using heating elements 33 can be selected according to need.

According to the present invention, a receiving member for receiving a substance to be melted is continuously heated without the need for a naked flame. Accordingly, a heating and melting apparatus of the invention is safe to use.

According to the present invention, the liquid obtained by melting the substance to be melted can be used effectively. Accordingly, the heating and melting apparatus of the invention is very well adapted for removing snow from roads, railways and the like.

In cases where the heating and melting apparatus of the invention is employed for snow removal, various advantageous effects can be obtained. One of these advantages is that the apparatus of the invention can be used in a narrow area such as in a rail-way station, a residential area, a cemetary, etc., since the snow can be removed without spreading the snow.

By employing the heating and melting apparatus of the present invention to a snow removing apparatus, following advantageous effects are obtained:

Operation can be performed smoothly, since snow is melted by the heating and melting apparatus without transferring the snow to another place.

Performance of snow removing is further enhanced since hot water is dispersed after melting the snow.

Reduction of working hours for snow removing can be carried out by means of melting the snow.

The number of operator for snow removing can be reduced since the apparatus is automatically operated.

Another advantage is that the number of operators can be reduced since the apparatus can be operated automatically.

In view of the above, it will be seen that the various objects of the invention have been fulfilled and many advantageous results are achieved.

What is claimed is:

1. A heating and melting apparatus comprising:

a receiving member (A) for receiving a substance to be melted;

a transferring member (B) for transferring the substance to be melted into the receiving member (A);

a heating member (C) including an induction heating device (IH) for heating said receiving member (A) in order to melt the substance in said receiving member;

a heat energy supply member (D) for supplying heating energy to said induction heating device (IH) of said heating member (C);

a liquid receiving member (E) including a vessel (12) for receiving and storing the liquid melted by said receiving member (A);

a liquid exhaust member (F) including a dispersion unit (14) for dispersing said liquid stored in the liquid receiving member (E); and an operation control member (G) including a sensor means (23, 24) for detecting temperature of said receiving member (A) and temperature of the liquid in said liquid receiving member (E), and a processing unit (26) for controlling said heat energy supply member (D) and said transferring member (B) in response to temperature-indicative signal from said sensor means (23, 24).

2. A heating and melting apparatus as claimed in claim 1, wherein said receiving means (A) comprises a container (2) for receiving a solid state substance to be melted and a melting tube (3) for melting the solid state substance.

3. A heating and melting apparatus as claimed in claim 2, wherein said transferring member (B) comprises a screw conveyor (4) provided rotatably in said melting tube (3) and a drive motor (5) for driving said screw conveyor (4) and for transferring a substance to be melted to the melting tube (3).

4. A heating and melting apparatus as claimed in claim 1, wherein said induction heating device (IH) of the heating member (C) comprises a heating coil (7) surrounding said melting tube (3) and a matching transformer (8).

5. A heating and melting apparatus as claimed in claim 1, wherein said heat energy supply member (D) comprises an electric power control unit (9) for controlling electric power and a frequency convertor (10) for controlling frequency of current to be supplied to said induction heating device (IH) in response to a signal from said power control unit (9).

6. A heating and melting apparatus as claimed in claim 1, wherein said dispersion unit (14) of the liquid exhaust member (F) comprises a dispersion pump (15) equipped with a motor (16), an ejection valve (17) and a pipe (18*a*) communicating the dispersion pump (15) and the liquid in said vessel (12).

7. A heating and melting apparatus as claimed in claim 1, wherein said liquid exhaust member (F) further comprises a return line (19) for feeding some of the liquid in the liquid receiving member (E) to said receiving member (A).

8. A heating and melting apparatus as claimed in claim 1, wherein said operation control member (G) comprises a sensor (23) for detecting a temperature of said melting tube (3), a sensor (24) for detecting the temperature of the liquid in said liquid receiving member (E), an input unit (25) receiving the detecting signals from said sensors (23, 24), a setting unit (27) for setting values of temperatures and the liquid in said vessel of said melting tube (3), and a processor (26) for controlling said transferring member (B), said heat energy supply member (D), said dispersion unit (14) of the liquid exhaust member (F) in response to an input signal and a set value of temperature in said setting unit (27).

9. A heating and melting apparatus as claimed in claim 1, further comprises a vehicle for mounting an electric power generator.

10. A heating and melting apparatus as claimed in claim 1, further comprises a vehicle for mounting a receiving member for receiving a substance to be melted, a transferring member for transferring the substance into the receiving member, a heating member for heating said receiving member in order to melt the substance in the receiving member, a heat energy supply member for supplying heating energy to said heating member, a liquid receiving member for receiving melt for said receiving member, a liquid exhaust member for exhausting the liquid stored in the liquid receiving member and, an operation control member for controlling said heat energy supply means and said liquid exhaust member.

11. A heating and melting apparatus comprising:

a receiving member (A) including a tube (3A) for receiving a substance to be melted;

a transferring member (B) for transferring the substance to be melted into said melting tubes (3A) of the receiving member (A);

a heating member (C) for heating the melting tube (3A) of said receiving member (A);

a heat energy supply member (D) for supplying heating energy to said heating member (C);

a liquid receiving member (E) for receiving and storing the liquid melted by said melting tube (3A); and an operation control member (G) for controlling said heating energy supply member (D);

said melting tube (3A) of the receiving member (A) including an outer tubular portion (41*a*), an inner tubular portion (41*c*) having smaller diameter than that of the outer tubular portion (41*a*), a first cavity

(44) formed axially and longitudinally between the outer tubular portion (41*a*) and inner tubular portion (41*c*) of said melting tube (3A) and a second cavity (45) formed in the inner tubular portion (41*c*), said heating means comprising a heating member (C) including a heat pipe (32) provided between said outer tubular portion and said inner tubular portion and for blowing hot gas into said second cavity (45) of the melting tube (3A).

12. A heating and melting apparatus as claimed in claim 11, wherein said heating member (C) comprises a heating element group (32*a*) consisting of the plurality of heat pipes (32).

13. A heating and melting apparatus as claimed in claim 11, wherein said heating member further includes an electric heater for heating said heat pipe.

14. A heating and melting apparatus as claimed in claim 11, wherein said operation control means comprises means for controlling selectively said heating member in accordance with the temperature of said melting tube.

15. A heating and melting apparatus as claimed in claim 11, further comprises a heat energy generating means including an air compressor for supplying compressed air to said heat pipe.

16. A heating and melting apparatus as claimed in claim 11, wherein said heating member further includes a means for routing exhaust gases of an internal combustion engine servicing as electrical generator through said receiving member.

17. A heating and melting apparatus as claimed in claim 15, wherein said heat energy generating means comprises an inductive heating device for heating said compressed air supplied to said heat pipe.

18. A heating and melting apparatus as claimed in claim 11, wherein said transferring member (B) comprises a screw conveyor (4) provided rotatably in said melting tube (3A) and a drive motor (5) for driving said screw conveyor (4) and for transferring a substance to be melted to the melting tube (3A).

19. A heating and melting apparatus as claimed in claim 11, wherein said heat energy supply member comprises an electric power control unit (9) for controlling electric power and a frequency convertor (10) for controlling the frequency of current to be supplied to said induction heating device (IH) in response to a signal from said power control unit (9).

20. A heating and melting apparatus as claimed in claim 11 further comprising a liquid exhaust member (F) including a dispersion unit (14) for dispersing the liquid stored in said liquid receiving member (E).

21. A heating and melting apparatus as claimed in claim 20, wherein said dispersion unit (14) of the liquid exhaust member (F) comprises a dispersion pump (15) equipped with a motor (16), and ejection valve (17) and a pipe (18*a*) communicating the dispersion pump (15) and the liquid in said vessel (12).

22. A heating and melting apparatus as claimed in claim 20, wherein said liquid exhaust member (F) further comprises a return line (19) for feeding some of the liquid in the vessel (12) of the liquid receiving member (E) to said receivng member (A).

23. A heating and melting apparatus as claimed in claim 21, wherein said operation control member comprises a sensor (23) for detecting a temperature of said melting pipe (3A), a sensor (24) for detecting the vessel (12) of the liquid receiving member (E), an input unit (25) receiving the detecting signals from said sensors (23, 24), a setting unit (27) for setting values of temperatures of said melting tube (3) and said vessel (12), and a processor (25) for controlling said transferring member (B), said heat energy supply member (D), said dispersion unit (14) of the liquid exhaust member (F) in response to an input signal and a set value of temperature in said setting unit (27).

* * * * *